US011103973B2

(12) United States Patent
Groth

(10) Patent No.: US 11,103,973 B2
(45) Date of Patent: Aug. 31, 2021

(54) CLAMPING DEVICE

(71) Applicant: Hilti Aktiengesellschaft, Schaan (LI)

(72) Inventor: Karin Groth, Landsberg am Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 412 days.

(21) Appl. No.: 16/074,739

(22) PCT Filed: Jan. 31, 2017

(86) PCT No.: PCT/EP2017/052000
§ 371 (c)(1),
(2) Date: Aug. 1, 2018

(87) PCT Pub. No.: WO2017/134037
PCT Pub. Date: Aug. 10, 2017

(65) Prior Publication Data

US 2019/0039205 A1 Feb. 7, 2019

(30) Foreign Application Priority Data

Feb. 2, 2016 (EP) ..... 16153793

(51) Int. Cl.
*B24B 45/00* (2006.01)
*B24B 23/02* (2006.01)
*B24B 27/08* (2006.01)

(52) U.S. Cl.
CPC ..... *B24B 45/006* (2013.01); *B24B 23/02* (2013.01); *B24B 27/08* (2013.01)

(58) Field of Classification Search
CPC ..... B24B 45/006; B24B 23/022; B24B 27/08; B24B 23/02; B27B 5/32; F16B 37/0864
See application file for complete search history.

(56) References Cited

U.S. PATENT DOCUMENTS 4,428,120 A * 1/1984 Kobayashi ..... B27B 5/32 30/390
7,186,172 B1 * 3/2007 Ohata ..... B24B 23/02 451/342

(Continued)

FOREIGN PATENT DOCUMENTS

DE 38 24 040 C1 11/1989
DE 103 11 491 B4 9/2004

(Continued)

OTHER PUBLICATIONS

PCT/EP2017/052000, International Search Report (PCT/ISA/220 and PCT/ISA/210) dated May 12, 2017, with partial English translation, enclosing Written Opinion of the International Searching Authority (PCT/ISA/237) (Thirteen (13) pages).

*Primary Examiner* — Matthew R McMahon
(74) *Attorney, Agent, or Firm* — Crowell & Moring LLP

(57) ABSTRACT

A clamping device for axially clamping a disk-shaped tool on a flange of a spindle of a machine tool, includes a clamping disk which rests against the tool in a friction-fitting manner in the clamped state, a screw which is screwed into a threaded receiving opening in an end face of the spindle, an operating element which is connected to the screw in a rotationally fixed manner, and a first securing element which interacts with a corresponding second securing element provided on a flange such that when the screw is at least partly introduced into the receiving opening, the clamping disk is rotationally secured to the flange in a form-fitting manner, where the clamping disk can be rotated relative to the screw and the operating element. The first securing element can be rotated relative to the screw and is mounted in a rotationally fixed manner relative to the clamping disk.

5 Claims, 9 Drawing Sheets

(56) References Cited

U.S. PATENT DOCUMENTS

| | | | | |
|---|---|---|---|---|
| 7,363,843 | B2 * | 4/2008 | Chiu | B27B 5/32 83/490 |
| 7,666,070 | B2 * | 2/2010 | Weber | B23B 31/4073 451/342 |
| 7,739,932 | B2 * | 6/2010 | Kraenzler | B24B 23/022 82/160 |
| 9,789,624 | B2 * | 10/2017 | Kimura | B23D 45/028 |
| 10,549,449 | B2 * | 2/2020 | Eiswerth | B27B 5/32 |
| 2010/0040474 | A1 * | 2/2010 | Takahashi | B27B 5/38 416/219 R |

FOREIGN PATENT DOCUMENTS

| | | |
|---|---|---|
| EP | 0 846 526 A2 | 6/1998 |
| EP | 2 123 380 A1 | 11/2009 |

* cited by examiner

Fig. 5a
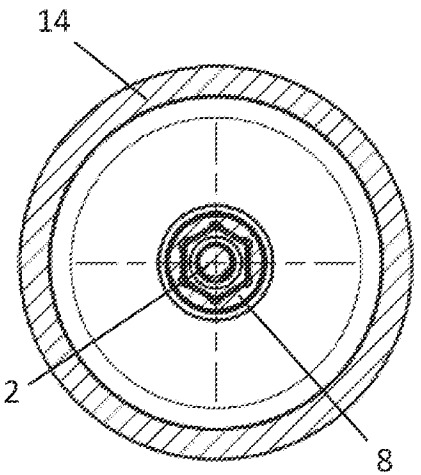
B–B
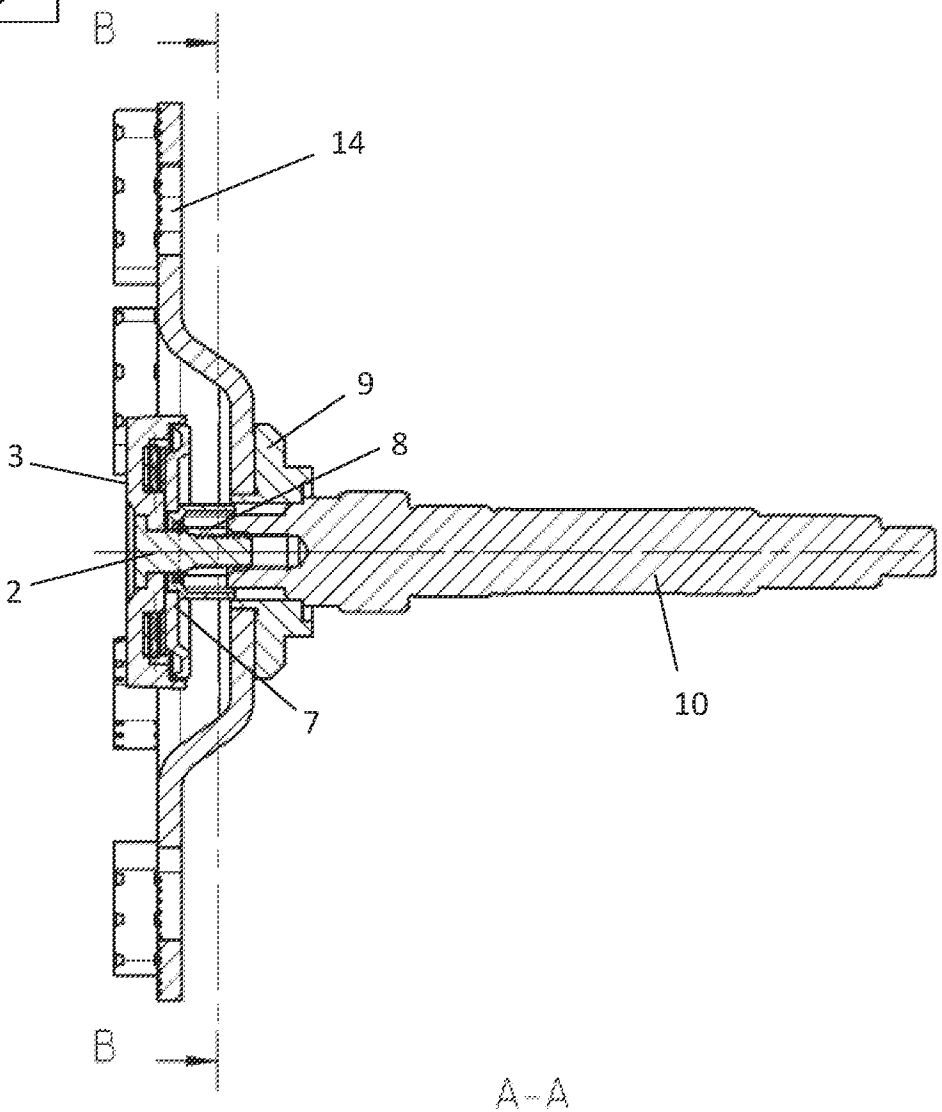
A–A
Fig. 5

CLAMPING DEVICE

CROSS REFERENCE TO RELATED APPLICATIONS

This application claims the priority of International Application No. PCT/EP2017/052000, filed Jan. 31, 2017, and European Patent Document No. 16153793.1, filed Feb. 2, 2016, the disclosures of which are expressly incorporated by reference herein.

BACKGROUND AND SUMMARY OF THE INVENTION

The present invention relates to a clamping device for axially clamping a disk-shaped tool, preferably a cutting disk, on a flange of a driven spindle of an electrical hand-held machine tool. The hand-held machine tool may, for example, be an angle grinder.

A driving torque applied to the spindle can, in the traditional design of disk-shaped tools, exclusively be transmitted to the disk-shaped tools in a friction-fit manner, because they have only a simple central hole as interface, and thus do not offer any working surfaces for a form-fit connection.

Fixing is by means of axial clamping of one or more disk-shaped tools against a rear flange on the spindle. The purpose of the clamping element is thus to apply sufficient axial clamping force, so that the force and the torque can be transmitted from the electrical hand-held machine tool to the disk-shaped tool. Sufficient clamping is characterized by the fact that the disk-shaped tools do not slip on the drive spindle.

Various clamping devices of the type mentioned at the beginning are known from the state of the art. These include, for example, clamping devices which require the use of an additional tool. Usually, disk-shaped tools on electrical hand-held machine tools (for example angle grinders, disk cutting devices) are mounted on the drive spindle by means of nuts, and tightened by means of a separate wrench (for example a two-pin spanner or open-end wrench). The great disadvantage of such clamping devices is the separate wrench, which must be carried in addition to the actual system, and can be lost.

Self-clamping clamping devices with release devices are also known from the state of the art. Clamping nuts that are initially fixed hand-tight, and rely on the self-clamping effect due to the reverse thrust on startup of the device, are known, for example from German patents DE 38 24 040 C1 and DE 10 311 491 B4. This effect is based on the inertia of the disk-shaped tools and the clamping nuts, and the reaction forces of the disk-shaped tools on cutting into the substrate. Force transmission via friction fit takes place between the disk-shaped tools, the clamping nut and the rear flange. The reaction forces cause the clamping nut to be increasingly tensioned against the rear flange via the disks. For the purpose of releasing, a technical release device is integrated into these clamping nuts, which enable the pretension on the nut to be removed before it is unscrewed.

The disadvantage of such damping devices lies in the fact that the degree of clamping force achieved by means of the self-clamping has no upper limit, as a result of which the clamping nut can be pretensioned to such an extent that the release mechanism can no longer be released by hand.

A further disadvantage is that the reaction torques arising due to inertia during rundown of the hand-held machine tool are also transmitted to the clamping nut, which can lead, particularly in hand-held machine tools with an active rundown brake, to self-acting rundown of the clamping nuts and of the disk-shaped tools. The running-down parts cause a hazard for the operator of the handheld machine tool.

A further possibility, known from the state of the art, for rendering a separate wrench superfluous consists of designing the clamping device in such a way that a manual force is sufficient during assembly to ensure sufficient clamping of the disk-shaped tool to the hand-held machine tool. For this purpose, either the manual force can be amplified and/or the friction losses minimized, in order to achieve a greater clamping force from the same limited manual force.

A known solution for improved utilization of the application torque in a high axial clamping force during clamping consists of a secondary thread, in which balls circulate, which becomes effective in the final phase of the clamping process. Such a solution is known, for example, from European publication EP 0 846 526 A2.

A disadvantage of this clamping device is that the dynamic reaction forces are not decoupled from the threaded section, and that, as a result, the clamping device, on the one hand, may be subjected to excessive self-clamping, and, on the other hand, may run down in the event of abrupt stopping of the spindle.

A further solution, known from the state of the art, for improved conversion of an application torque into a high axial clamping force during clamping consists in selecting a thread with a smaller diameter and small pitch, and additionally minimizing the screw head friction by means of a roller bearing. In addition, dynamic reaction forces are absorbed by form-fit elements between the clamping disk oriented toward the cutting disks, and the drive spindle, as a result of which self-clamping and self-acting rundown are prevented. Such a clamping device from the company ITW Befestigungssysteme GmbH Spit is known from the market.

The object of the present invention is therefore to provide a clamping device by means of which the disadvantages described above can be eliminated, and, in particular, jamming between a securing element of the clamping device and a corresponding securing element provided on a spindle can be avoided.

The object is achieved in particular by means of the fact that a clamping device is provided for axial clamping of a disk-shaped tool, preferably a cutting disk, on a flange of a drivable spindle of a hand-held machine tool, comprising a clamping disk which rests against the tool in a friction-fitting manner in the clamped state, a central screw which can be screwed into a threaded receiving opening formed in an end face of the spindle, an operating element which can be connected to the screw in a rotationally fixed manner such that a manual force introduced into the operating element is transmitted to the screw in the form of an application torque, and a first securing element which is designed to interact with a corresponding second securing element provided on the flange such that when the screw is at least partly introduced into the receiving opening, the clamping disk is rotationally secured to the flange in a form-fitting manner, wherein the clamping disk can be rotated relative to the screw and the operating element.

According to the invention, the first securing element of the clamping device can be rotated relative to the screw, and is mounted in a rotationally fixed manner relative to the clamping disk. This ensures that a torque applied by the user and acting on the screw, or on the unit formed by the screw and the operating element, is converted in a particularly efficient manner into an axially acting clamping force for securing the disk-shaped tool to the drivable spindle of the hand-held machine tool.

The invention includes the recognition that, as a result of the fact that the clamping disk can be freely rotated relative to the screw, or to the driven unit formed by the screw and the operating element, a relative position in the circumferential direction between the clamping disk and the screw, or between the clamping disk and the operating elements, is not clearly defined. A position between the first securing element and the corresponding second securing element when screwing the central screw into the threaded receiving opening formed on the end face of the spindle is thus also not defined.

According to a beneficial embodiment of the present invention, provision can be made for the first securing element to be designed in the form of a sleeve with a polygonal internal profile, and for the second securing element to include an external profile that corresponds to the polygonal internal profile of the first securing element, so that the first securing element can be pushed onto the second securing element. Pushing the first securing element onto the second securing element ensures that precise positioning, and hence reliable interaction, of the two securing elements in respect of one another can be achieved.

Furthermore, the advantage is provided that the spindle of the hand-held machine tool can, as a result, be designed especially simply, such that it remains free of moving parts that facilitate synchronization.

To ensure a reliable and, in particular, precisely-fitting arrangement of the clamping disk in respect of the first and second securing element, provision can be made, according to a further beneficial embodiment of the present invention, for the clamping disk to include a central recess, and for the first securing element to include an external profile that corresponds to the central recess, so that the first securing element can be inserted into the clamping disk.

According to a further beneficial embodiment of the present invention, provision can be made for the clamping disk and the first securing element to be designed as a single piece. This ensures even better transmission of force and torque from the clamping disk to the first securing element.

In addition, in a further beneficial embodiment of the present invention, provision can be made for the screw to be designed such that a screw thread is only capable of engaging in the thread of the receiving opening if, in an assembled condition of the clamping device, the first securing element has, at least partly, a form-fit interaction with the second securing element. This ensures that the user can only turn the screw correctly into the thread of the receiving opening if the first and second securing element are properly arranged in respect of one another, or the clamping device is correctly assembled. In other words: if the first and second securing element are connected to each other in a form-fitting manner.

It has proven to be advantageous for the operating element to be designed in the form of a cover, which preferably encloses the clamping disk, at least partially.

In a particularly beneficial embodiment of the present invention, the clamping device has a bearing. The bearing is preferably a needle roller thrust bearing. The bearing is arranged for the purpose of rotational decoupling of the screw and clamping disk, especially but preferably not exclusively if the clamping disk is rotationally secured to the flange in a form-fitting manner.

It has proven to be particularly advantageous for the operating element, the clamping disk and the first securing element to be arranged coaxially in respect of one another on the screw. The operating element, the clamping disk and the first securing element are preferably held by means of at least one retaining ring in or at least partially in the operating element.

Further benefits arise from the following description of the Figures. Different implementation examples of the present invention are shown in the Figures. The Figures, the description and the claims contain numerous features in combination. A person skilled in the art will also advantageously consider the features individually and in further sensible combinations.

In the Figures, the same components, and components of the same type, are numbered with the same reference numbers.

BRIEF DESCRIPTION OF THE DRAWINGS

FIG. 5 is a further side cross-section view of the clamping device along line of intersection A-A in FIG. 1;

FIG. 5*a* is a cross-section view of the clamping device along line of intersection B-B in FIG. 5;

DETAILED DESCRIPTION OF THE DRAWINGS

Figure 1:
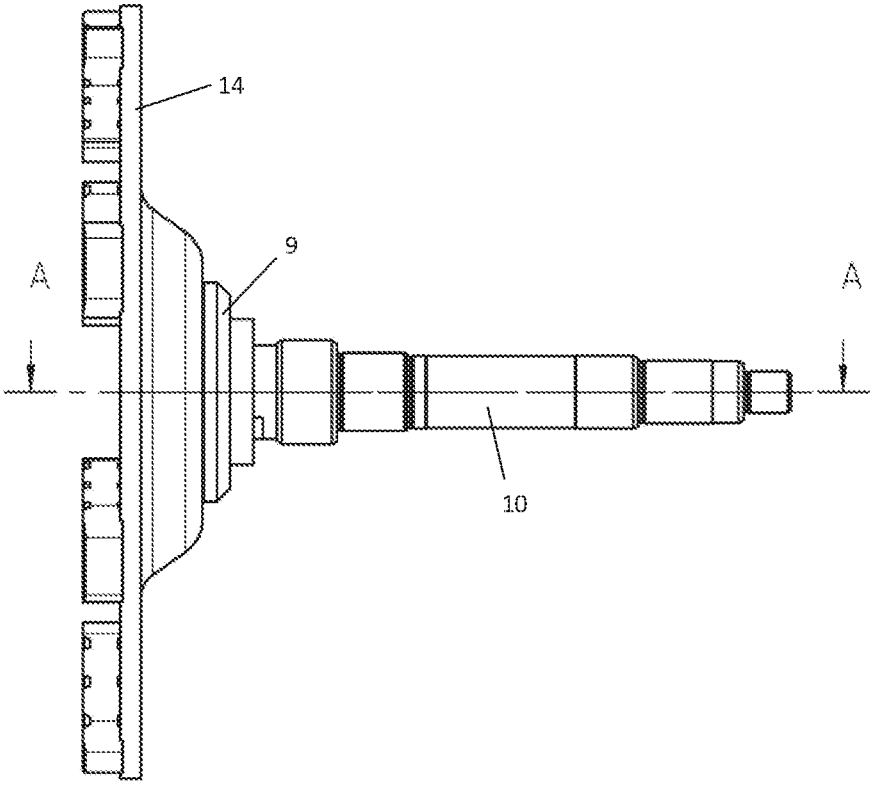
FIG. 1 is a side view of a clamping device according to the invention with a disk-shaped tool in an assembled condition of the clamping device.

A clamping device 1 according to the invention is shown in an assembled condition in FIG. 1.

Figure 2:
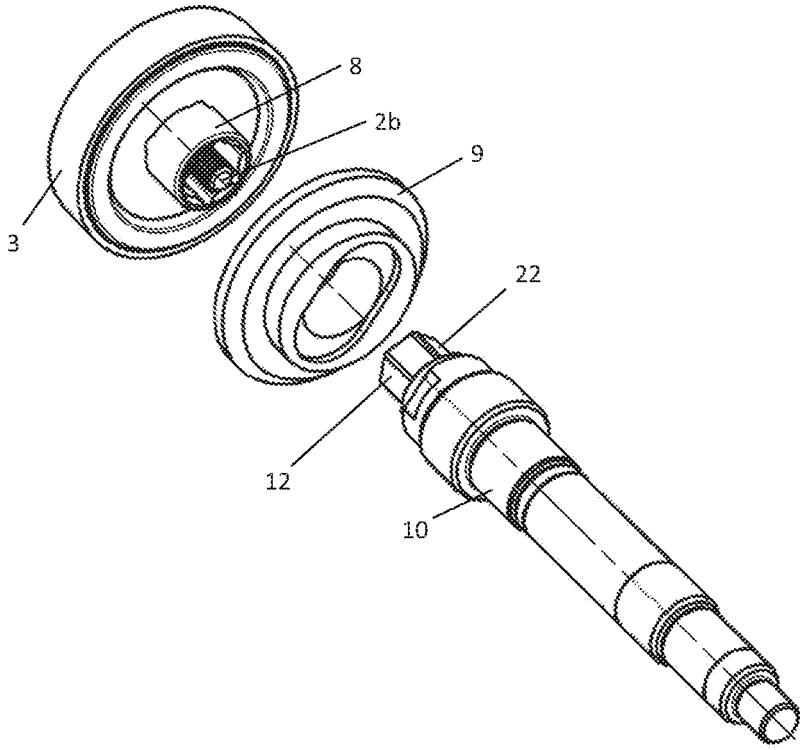
FIG. 2 is a perspective view of the clamping device in a disassembled condition of the clamping device without the disk-shaped tool.
Figure 3:
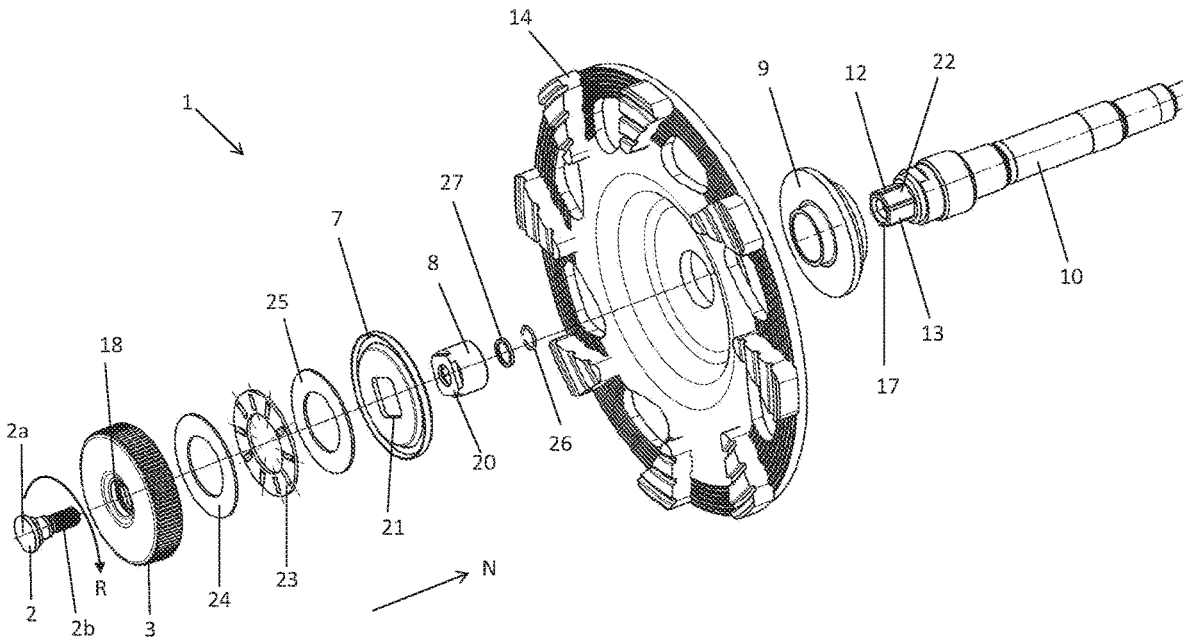
FIG. 3 is a perspective view of the clamping device in a disassembled condition of the clamping device.
Figure 4:
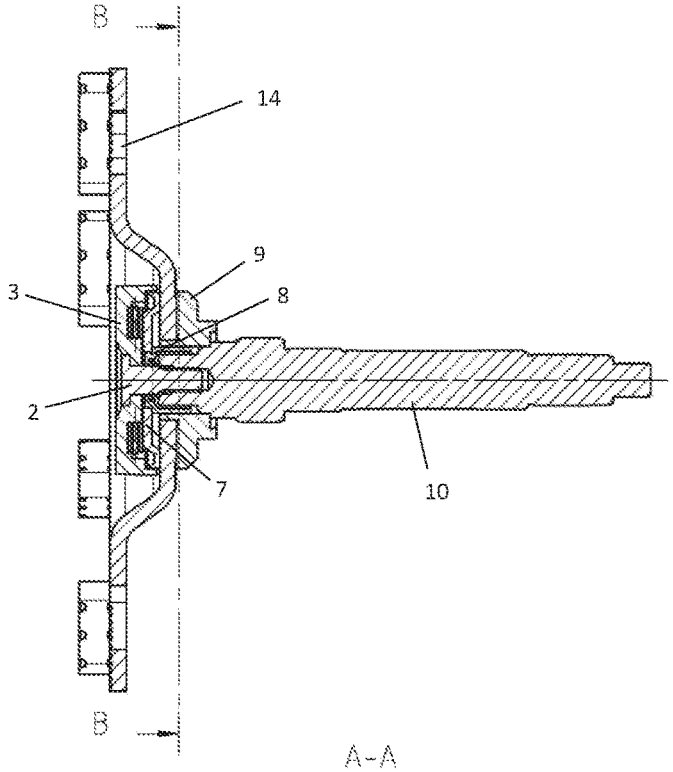
FIG. 4 is a side cross-section view of the clamping device along line of intersection A-A in FIG. 1.
Figure 4A:
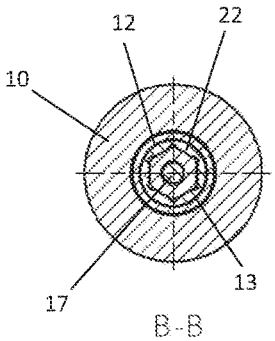
FIG. 4*a* is a cross-section view of the clamping device along line of intersection B-B in FIG. 4.

The clamping device 1 essentially comprises a screw 2, an operating element 3, a first running disk 24, a needle roller thrust bearing 23, a second running disk 25, a clamping disk 7, a first securing element 8 and a counter-clamping disk 9 (see FIGS. 1, 2, 3). The clamping device 1 interacts with a spindle 10 of a hand-held machine tool not shown in the Figures. The spindle 10 additionally includes a second securing element 12, which is located on a flange 13 of the spindle 10 (see FIGS. 2, 3).

The clamping device 1 serves for axial clamping of a disk-shaped tool 14 to the flange 13 of the driven spindle 10 shown on the right in FIG. 1. The driven spindle 10 belongs to a hand-held machine tool not shown in the Figures, which may, for example, be an angle grinder. The disk-shaped tool 14 may, for example, be a plate-shaped grinding wheel.

It is, however, also possible for the disk-shaped tool 14 to be a flat cutting disk. The hand-held machine tool (not shown) may be an angle grinder or similar. Alternatively, the clamping device according to the invention may also be implemented in a non-hand-held machine tool.

The clamping device 1 incorporates a clamping disk 7 which, in an assembled or clamped condition of the clamping device 1, rests against the tool 14, for example, a plate-shaped grinding wheel, in a friction-fitting manner, in order to clamp it to the spindle 10 of the hand-held machine tool (not shown).

The screw 2 is a central screw, which, in the assembled condition, holds together the entire clamping device 1. The screw 2 includes a screw head 2*a* and a thread 2*b*, which can be screwed into a thread 15, which is formed in a receiving opening 16 on a free end face 17 of the spindle 10.

The operating element 3 is formed essentially as a cover with a central recess 18. The recess 18 serves to receive and provide a form-fit connection of the operating element 3 with the screw 2. As a result of the form-fit of operating element 3 and screw 2, the operating element 3 is connected to the screw 2 in a rotationally fixed manner such that a manual force introduced into the operating element 3 by rotation of operating element 3 in a radial direction R is transmitted to the screw 2 in the form of an application torque. The form-fit connection between the screw 2 and the operating element 3 is achieved by means of a corresponding profile device on the central recess 18 of operating element 3 and the screw head 2*a* of the screw 2. Alternatively, the screw 2 and the operating element 3 can also be designed as a single piece, or joined by means of a substance-to-substance bond (adhesive bonding, welding, soldering or similar).

Figure 8:
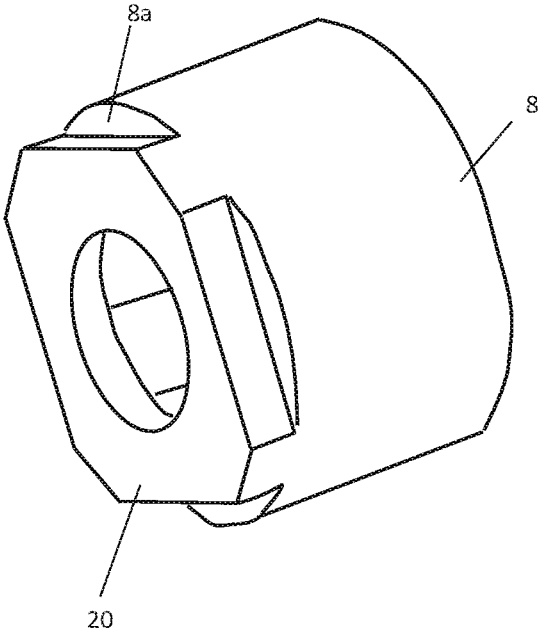
FIG. 8 is a perspective view of the first securing element.
Figure 9:
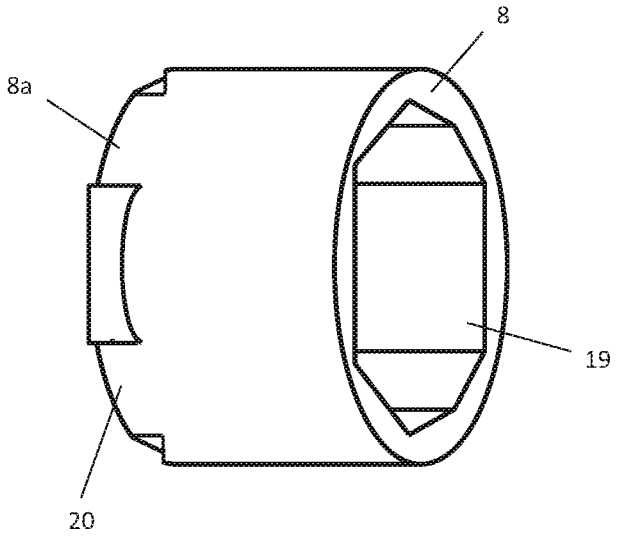
FIG. 9 is a further perspective view of the first securing element.

The first securing element 8 of the clamping device 1 is designed as a sleeve with a hexagonal internal profile 19 in the implementation example shown in FIG. 1 (see also FIGS. 8 and 9). It is thus essentially similar to a nut with hexagonal socket. In addition, the first securing element 8 incorporates a polygonal external profile 20 at one end 8*a*. As shown in particular in FIG. 8, the polygonal external profile 20 is essentially a square profile with chamfered corners.

The clamping disk 7 has an essentially square recess 21 in the center. The shape of the recess 21 corresponds to the square external profile 20 of the first securing element 8, so that the square external profile 20 of the first securing element 8 can be inserted into the square recess 21 of the clamping disk 7. As a result, the first securing element 8 and the clamping disk 7 can be connected to each other in a form-fitting manner.

Alternatively, the first securing element 8 and the clamping disk 7 can also have a different external profile and recesses that correspond to one another. Furthermore, the first securing element 8 and the clamping disk 7 can also be designed as a single piece, or joined to one another by means of a substance-to-substance bond.

Figure 6:
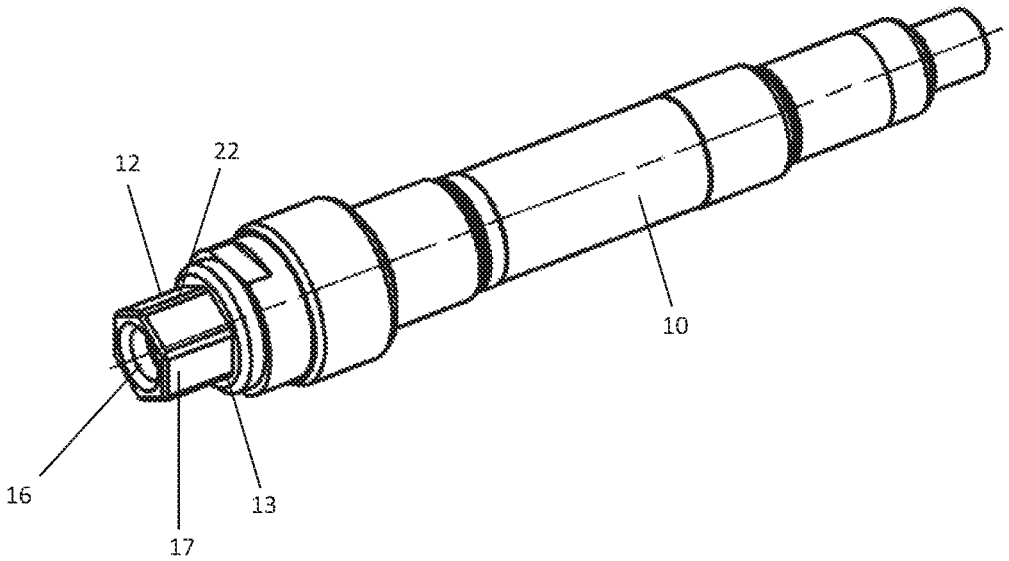
FIG. 6 is a perspective view of the spindle.
Figure 7:
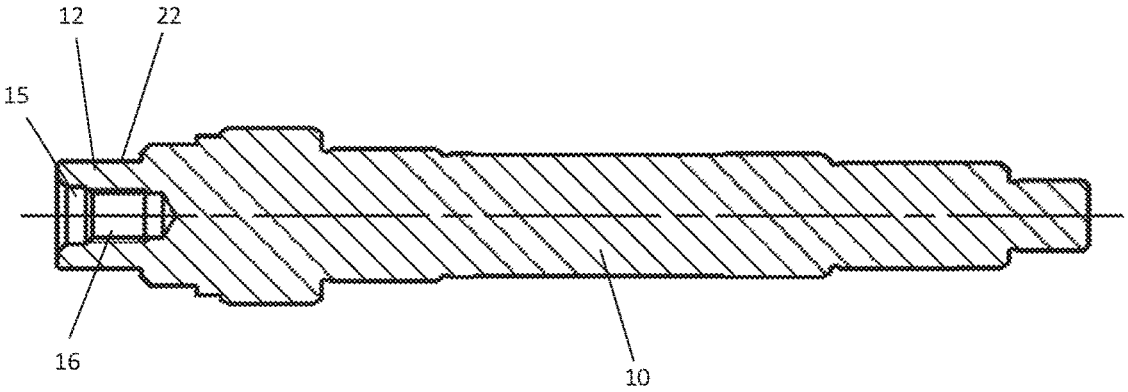
FIG. 7 is a side cross-section view of the spindle.

A second securing element 12 that corresponds to the first securing element 8 is positioned on the flange 13 of the spindle 10. As shown in particular in FIGS. 2, 3, 6, the second securing element 12 incorporates a hexagonal external profile 22 which corresponds to the hexagonal internal profile 19 of the first securing element 8. If hexagonal internal profile 19 of the first securing element 8 is engaged with the hexagonal external profile 22 of the second securing element 12, not only the first securing element 8 and the second securing element 12 but also the clamping disk 7 and the flange 13 are rotationally secured to each other in a form fitting manner.

As already mentioned above, this is realized in the present implementation example in such a way that the external profile 20 of the first securing element 8 projects into the corresponding recess 21 of the clamping disk 7, the internal profile 19 of the first securing element 8 is pushed onto the external profile 22 of the second securing element 12, and the screw 2 is screwed in direction N through the clamping disk 7, the first securing element 8, the disk-shaped tool 14 and into the receiving opening 16 equipped with the thread 15 of the spindle 10 (see FIG. 3). The clamping disk 7, the first securing element 8 and the second securing element 12 are thus connected to each other in a form-fitting manner.

According to the invention, the first securing element 8 of the clamping device 1 can be rotated relative to the screw 2, and is mounted in a rotationally fixed manner relative to the clamping disk 7.

The clamping device 1 has, in the present case, a bearing 23 in the form of a needle roller thrust bearing which is supported between two running disks 24, 25. The bearing 23 designed as a needle roller thrust bearing serves for rotational decoupling of screw 2 and clamping disk 7, if the clamping disk 7 is rotationally secured to the flange 13 in a form-fitting manner.

As can also be seen in FIG. 1, the screw 2, the operating element 3, the two running disks 24, 25, the first securing element 8 and the clamping disk 7 are arranged coaxially in respect of one another.

In the assembled condition (see FIG. 2), the operating element 3, the clamping disk 7, the first securing element 8, the two running disks 24, 25 and the needle roller thrust bearing 23 are arranged on the screw 2, and secured to the latter by means of a retaining ring 26 in the form of a snap ring. An additional ring 27 serves to ensure that the force acting axially in the assembled condition of the clamping device 1 is redirected such that a radial force component arises on the retaining ring 26.

The invention claimed is:

1. A clamping device for axially clamping a disk-shaped tool on a flange of a drivable spindle of a hand-held machine tool, comprising:

a clamping disk, wherein the clamping disk is restable against the disk-shaped tool in a friction-fitting manner in a clamped state;

a screw, wherein the screw is screwable into a threaded receiving opening formed in an end face of the spindle;

an operating element, wherein the screw and the operating element are each an individual component and wherein the screw and the operating element are is connectable to each other in a rotationally fixed manner such that a manual force introduced into the operating element is transmitted to the screw in a form of an application torque; and a first securing element, wherein the first securing element interacts with a second securing element provided on the flange such that when the screw is at least partly introduced into the receiving opening, the clamping disk is rotationally secured to the flange in a form-fitting manner, wherein the clamping disk is rotatable relative to the screw and the operating element;

wherein the first securing element is rotatable relative to the screw and is mounted in a rotationally fixed manner relative to the clamping disk;

wherein the first securing element is an individual component which is a sleeve with a polygonal internal profile and wherein the second securing element has an external profile that corresponds to the polygonal internal profile of the first securing element such that the first securing element is pushable onto the second securing element;

wherein the clamping disk has a central recess and wherein the first securing element has an external profile that corresponds to the central recess such that the first securing element is insertable into the clamping disk.

2. The clamping device according to claim 1, wherein a thread of the screw is only capable of engaging in the thread of the receiving opening if, in an assembled condition of the clamping device, the first securing element has, at least partly, a form-fit interaction with the second securing element.

3. The clamping device according to claim 1, wherein the operating element is a cover which encloses the clamping disk at least partially.

4. The clamping device according to claim 1 further comprising a bearing, wherein the bearing provides for rotational decoupling of the screw and clamping disk if the clamping disk is rotationally secured to the flange in a form-fitting manner.

5. The clamping device according to claim 1, wherein the operating element, the clamping disk, and the first securing element are arranged coaxially with respect to one another on the screw and secured to the screw by a retaining ring.

* * * * *